US009284158B2

(12) United States Patent
Sarjanen

(10) Patent No.: US 9,284,158 B2
(45) Date of Patent: Mar. 15, 2016

(54) ELEVATOR SYSTEM

(71) Applicant: Jukka-Pekka Sarjanen, Vantaa (FI)

(72) Inventor: Jukka-Pekka Sarjanen, Vantaa (FI)

(73) Assignee: KONE Corporation, Helsinki (FI)

( * ) Notice: Subject to any disclaimer, the term of this patent is extended or adjusted under 35 U.S.C. 154(b) by 660 days.

(21) Appl. No.: 13/684,984

(22) Filed: Nov. 26, 2012

(65) Prior Publication Data

US 2013/0153339 A1 Jun. 20, 2013

(30) Foreign Application Priority Data

Dec. 15, 2011 (FI) ..... 20116270

(51) Int. Cl.
*B66B 1/20* (2006.01)
*B66B 1/46* (2006.01)
*B66B 1/24* (2006.01)

(52) U.S. Cl.
CPC ..... *B66B 1/468* (2013.01); *B66B 1/2408* (2013.01); *B66B 2201/4623* (2013.01); *B66B 2201/4653* (2013.01)

(58) Field of Classification Search
CPC ..... B66B 1/468; B66B 1/2408; B66B 2201/4623; B66B 2201/4653
USPC ..... 187/247, 277, 380–389, 391, 393
See application file for complete search history.

(56) References Cited

U.S. PATENT DOCUMENTS 4,685,538 A * 8/1987 Kamaike ..... 187/380
4,852,695 A * 8/1989 Ostrowiecki ..... 187/382
5,952,626 A 9/1999 Zaharia
6,868,945 B2 * 3/2005 Schuster et al. ..... 187/380
6,986,408 B2 * 1/2006 Takeuchi ..... 187/380
7,162,233 B2 * 1/2007 Chiba ..... 455/420
7,353,915 B2 * 4/2008 Zaharia et al. ..... 187/388
7,377,364 B2 * 5/2008 Tyni et al. ..... 187/380
7,610,995 B2 * 11/2009 Ylinen et al. ..... 187/382
7,849,974 B2 * 12/2010 Stanley et al. ..... 187/387
7,882,938 B2 * 2/2011 Blackaby et al. ..... 187/388
7,882,939 B2 * 2/2011 Nakamura ..... 187/391
8,151,942 B2 * 4/2012 Rusanen et al. ..... 187/247
8,485,317 B2 * 7/2013 Gerstenkorn et al. ..... 187/247
2012/0090922 A1 4/2012 Elomaa et al.

FOREIGN PATENT DOCUMENTS

EP 0970911 A2 1/2000
JP 2004-43100 2/2004
WO WO-2010/139846 A1 12/2010

OTHER PUBLICATIONS

European Search Report dated Jul. 4, 2014 issued in corresponding European Application No. 12194289.0 (full English translation).

* cited by examiner

*Primary Examiner* — Anthony Salata
(74) *Attorney, Agent, or Firm* — Harness, Dickey & Pierce, P.L.C.

(57) ABSTRACT

The present invention is directed towards a method and a system for allocating elevators on the basis of advance calls. According to the invention an advance call is registered, address data is connected to the advance call, an elevator is allocated when the activation condition of the advance call is fulfilled, and information about the allocation of the elevator is sent to the passenger by sending a notification to the address indicated by the address data.

18 Claims, 1 Drawing Sheet

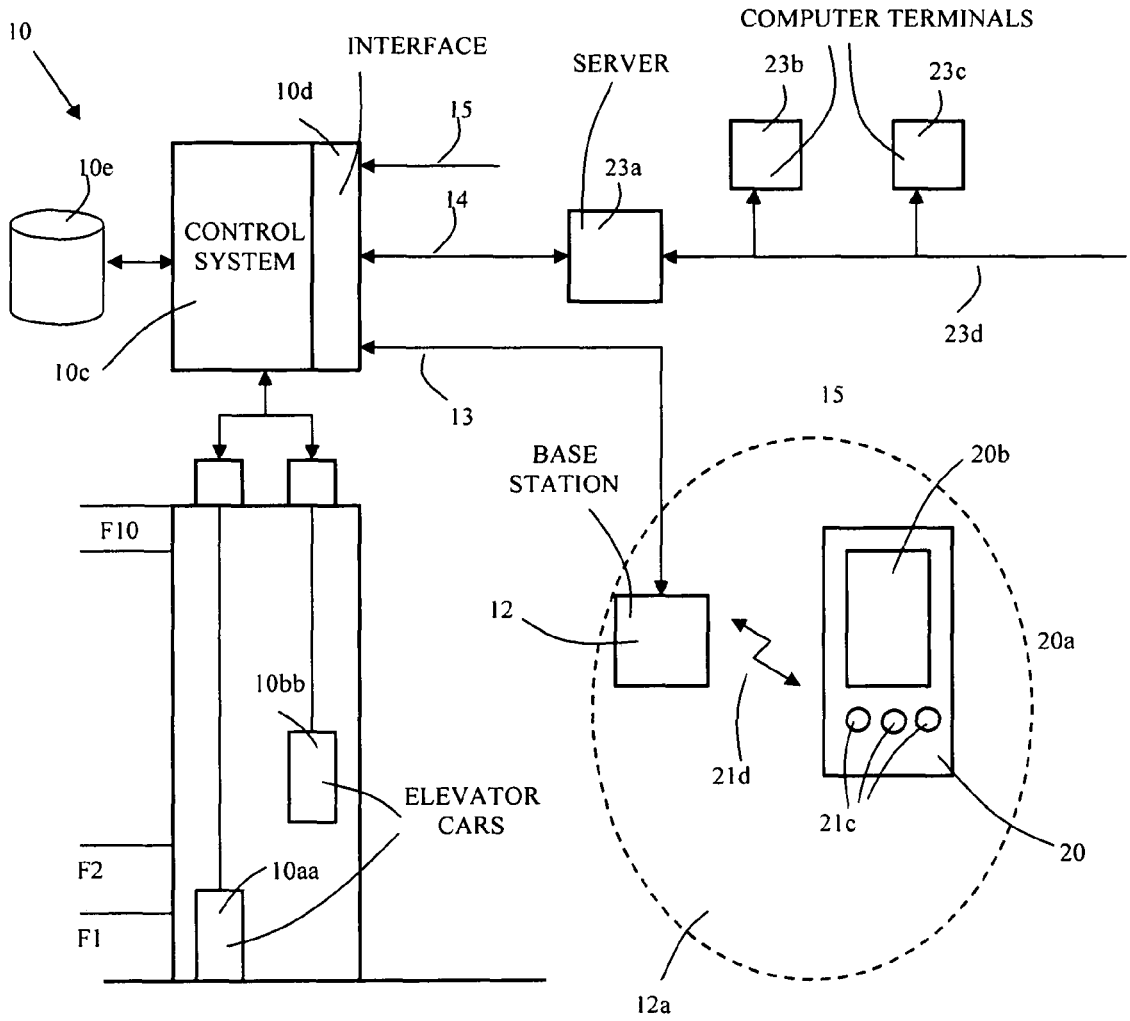
10
INTERFACE
COMPUTER TERMINALS
SERVER
23b
23c
10d
15
10e
23a
14
CONTROL SYSTEM
23d
10c
13
15
BASE STATION
20b
F10
12
20a
10bb
21d
ELEVATOR CARS
21c
20
F2
10aa
F1
12a

ELEVATOR SYSTEM

CROSS REFERENCE TO RELATED APPLICATIONS

This application claims priority to Finnish Application Number 20116270 filed Dec. 15, 2011, the entire contents of each of which are hereby incorporated herein by reference.

FIELD OF THE INVENTION

The invention relates to elevator systems. More particularly the invention relates to giving advance calls to an elevator system.

BACKGROUND OF THE INVENTION

Concerning elevator systems, a call-giving method is known wherein a passenger gives a so-called destination call in the elevator lobby before going into the elevator car. The elevator system registers the destination call given by the passenger and allocates immediately an elevator car to the passenger on the basis of the desired optimization criteria and also on the basis of the traffic situation prevailing in the elevator system. A destination call can generally be given by the aid of a call-giving panel disposed in the elevator lobby or by the aid of a personal terminal device. The elevator allocated is notified to the passenger who gave the call e.g. on the display of the call-giving device, after which the passenger can transfer to wait for the arrival of the elevator in question by the elevator. If the elevator system is congested, the arrival of the elevator can take many minutes. For example, in office buildings it is usual that employees arrive at roughly the same time at their workplace in the mornings, in which case so-called upward peak traffic forms in the elevator system. Correspondingly, in the afternoons, when most employees leave their workplace at roughly the same time, so-called downward peak traffic forms in the elevator system. Therefore, it is probable that passengers using the elevator system have to momentarily wait unreasonably long times for the elevators serving then, because the transport capacity of the elevator system is not sufficient to serve all the passengers for achieving the desired service targets. The central problem is that congestion occurs momentarily because passengers want to use the elevators at the same time of day.

So that the transport capacity of the elevator system could be utilized better, the transport capacity should be used more evenly and momentary traffic peaks should be avoided. In solutions according to prior art, this is generally not possible, if passengers are accustomed to using the elevators at the same times of day.

AIM OF THE INVENTION

The aim of the present invention is to disclose a solution, which eliminates or at least alleviates the drawbacks presented above that occur in prior-art solutions. The aim of the invention is also to achieve one or more of the following advantages:

- to improve the transportation capacity of an elevator system,
- to improve passenger service, and
- to make giving calls easier.

SUMMARY OF THE INVENTION

The method according to the invention is characterized by what is disclosed in the characterization part of claim 1. The elevator system according to the invention is characterized by what is disclosed in the characterization part of claim 11. Other embodiments of the invention are characterized by what is disclosed in the other claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the scope of the basic inventive concept in conjunction with other embodiments.

The present invention discloses a method for allocating an elevator in an elevator system, which comprises at least one elevator and also an interface for transmitting data connected to advance calls. According to the invention an advance call is registered via the aforementioned interface on the basis of the data received, the address data of at least one passenger is connected to the advance call, and an elevator is allocated for the use of the passenger when the activation condition connected to the advance call is fulfilled. A notification about the allocation of an elevator is sent to the address indicated by the address data for informing the passenger about the elevator serving him/her.

An advance call means, in this context, an elevator call that is recorded in the elevator system for being performed at a later time that is determined by the activation condition connected to the advance call. The idea is that the elevator system calls the passenger, unlike in conventional elevator systems wherein the passenger calls the elevator. Information about the destination floor, or about another point in the building to which the passenger wants to get to at a later time, can be connected to an advance call. An activation condition is e.g. a time window, during which a passenger wants to use elevators to get to the point to which he/she wants to go. When an activation condition is fulfilled, the elevator system allocates an elevator for the use of the passenger for taking the passenger to the point according to the advance call. The passenger is notified about the allocation of an elevator by sending a notification to the address connected to the advance call. An address is e.g. the mobile phone number or e-mail address of a passenger. In the notification the passenger can be told, e.g. by text message or by e-mail, which elevator will collect the passenger and when. The address data also of a number of passengers can be connected to an advance call, in which case at issue is a passenger group to which, traffic situation permitting, one elevator car is allocated.

In one embodiment of the invention a passenger registers an advance call by the aid of a personal terminal device, e.g. by the aid of a mobile phone. In another embodiment an advance call is registered from an information system, which is connected via an interface to the elevator system. In this embodiment a passenger registers an advance call, e.g. from a computer terminal at his/her workpoint, or an information system automatically registers a passenger-specific advance call e.g. on the basis of the calendar data of the passenger.

In one embodiment of the invention the elevator system monitors an external excitation signal, the state of which is monitored in an activation condition. The excitation signal can be e.g. advance information about the arrival of a metro train at a neighborhood stop.

In one embodiment of the invention the location of a passenger in the building is determined. On the basis of the location the elevator system estimates the walking time of the passenger to the elevator to be allocated, or to the already allocated elevator, and configures the arrival of the elevator at the floor on the basis of the estimated walking time.

In one embodiment of the invention a passenger sends the acknowledgement he/she wants to the notification sent by the elevator system concerning the elevator allocated on the basis of an advance call. With the acknowledgement the passenger can e.g. accept the elevator service, cancel the elevator service or change the time of the elevator service.

In one embodiment of the invention statistical data about the elevator journeys made by a passenger are collected. On the basis of the statistical data the elevator system automatically generates an advance call.

The present invention also discloses an elevator system, which comprises at least one elevator, a control system controlling the elevator system, which control system comprises an interface for transmitting data connected to advance calls. The control system is arranged to register an advance call via the interface on the basis of the data received, to connect the address data of at least one passenger to the advance call, to allocate an elevator for the use of the passenger when the activation condition of the advance call is fulfilled, and to send via the interface a notification to the passenger about the allocated elevator to the address indicated by the address data.

With the solution according to the invention numerous advantages are achieved compared to prior-art solutions. The transport capacity of an elevator system can be utilized better because the elevator system can match carryings of passengers more freely than before. Passenger service can be improved by sending to a passenger a notification of when an elevator serving him/her will arrive at the departure floor of the passenger. By taking into account the location of a passenger in the building, the arrival of an elevator at a floor level can be scheduled more precisely than before. The elevator system can also learn the ways a passenger is accustomed to move in the building and can register advance calls automatically for the passenger after a "learning cycle". By monitoring events external to the elevator system, passenger service can be further improved, because a passenger does not himself/herself need to take care about e.g. the arrival of a metro train at the neighborhood station.

LIST OF FIGURES

In the following, the invention will be described in detail by the aid of a few examples of its embodiments, wherein:

FIG. 1 presents one elevator system according to the invention, and

DETAILED DESCRIPTION OF THE INVENTION

FIG. 1 presents one elevator system 10 according to the invention. The elevator system 10 is formed from an elevator group, which comprises two elevators 10*a*, 10*b*, the elevator cars 10*aa*, 10*bb* of which move in the elevator hoistway between the floors F1, F2 . . . F10 controlled by the control system 10*c*. The elevator lobbies of the floors F1, F2 . . . F10 comprise e.g. destination call panels (not presented in FIG. 1) for registering destination calls given by passengers. The control system 10*c* comprises an interface 10*d* for receiving/sending data connected to advance calls and also a memory 10*e* for recording data connected to advance calls.

In FIG. 1 the server 23*a* of the local area network 23*d* in the building is connected to the interface 10*d* of the control system 10*c* via a data transfer connection 14. The data transfer connection 14 can be any data transfer connection whatsoever suited to the purpose, e.g. a wireless data transfer connection. Connected to the local area network 23*d* are computer terminals 23*b* and 23*c*, which are e.g. "work machines" in the personal use of people working in the same company Marked with the reference number 12 in FIG. 1 is a base station, via which a terminal device 20 in the possession of a passenger and the control system 10*c* can transmit data to each other wirelessly. A terminal device 20 is a personal device suited to wireless communications, e.g. a mobile phone, the user interface of which comprises a screen 20*b* and a plurality of pushbuttons 21*c*. The data transfer connection 20*d* between the base station 12 and the terminal device 20 can be based on any data transfer technology whatsoever that is suited to the purpose, e.g. Bluetooth or WLAN technology. FIG. 1 presents only one base station 12, but if necessary there can be more than one, e.g. one base station on each floor F1 . . . F10.

Application software is installed in a terminal device for registering destination calls and advance calls. When a passenger is in the operating range 12*a* of a base station 12 in the building, the terminal device 20 and the control system 10*c* can transmit data connected to advance calls to each other. If a passenger wants to register an advance call, he/she starts the aforementioned application software, enters the departure floor of the advance call, the destination floor of the advance call, and also the activation condition of the advance call. The terminal device 20 sends the information entered and also the identification data of the passenger via the base station 12 to the control system 10*c*. The identification data is e.g. a phone number of a mobile phone 20 or an individual ID number. If the identification data is a phone number or other individual communication address, it is simultaneously the address data to which the control system 10*c* sends a notification about the allocation of an elevator according to an advance call. If the identification data is an ID number, the address data corresponding to the ID number, e.g. the aforementioned phone number or e-mail address, must be recorded in the memory 10*e* of the control system. An activation condition is e.g. a time of day, on the basis of which the elevator system allocates an elevator to a passenger. For example, if a passenger is going to leave the building at approx. 16.00, he/she can set the activation time of an advance call at 16.00. The elevator system allocates an elevator for the use of the passenger at 16.00 or after that, e.g. inside the time window 16.00-16.10. The exact moment of allocation is determined e.g. on the basis of the traffic situation prevailing in the elevator system. If the elevator system is congested, and the elevator fulfilling the given optimization criteria is not released within the aforementioned time window, information is sent to the passenger about the delay of the elevator transportation.

The monitoring of one or more excitation signals 15 can also be connected to an activation condition, on the basis of which monitoring it is deduced whether the activation condition is fulfilled, i.e. is the activation condition true. An excitation signal 15 can be a measurable electrical magnitude or event data, which is transmitted via the interface 10*d* to the control system 10*c*. For example, a list of excitation signals can be presented to a passenger on a terminal device 20, from which excitation signals the passenger can pick the excitation signal or excitation signals he/she wants in an activation condition.

When the allocation decision has been made in the control system 10*c*, it sends a notification to the address according to the advance call about which elevator will serve the passenger and when. The passenger receives e.g. the text message "Go to elevator B within two minutes" on his/her mobile phone. Elevator B arrives after two minutes at the departure floor according to the advance call, opens the doors of the elevator car and, after the passenger has transferred into the elevator car, takes the passenger to the destination floor according to the advance call. The passenger can send an acknowledgement to a notification he/she receives. He/she can e.g. press the "OK" pushbutton 21*c* of the terminal device 20 as notification that he/she is going to use the allocated elevator, the "CANCEL" pushbutton 21*c* for cancelling the allocation of the elevator, or the "LATER" pushbutton 21*c* for postponing the arrival time of the elevator e.g. to 10 minutes later. The acknowledgement data is transmitted from the terminal device to the control system 10*c*, which performs the procedures required by the acknowledgement.

A position location system can be installed in the building, by the aid of which system the passengers in the building can be located individually. The position location system can be based on any position location technology whatsoever that is suited to the purpose, e.g. on the use of base stations 12 that are in the building. When the activation condition of an advance call is fulfilled, the control system 10*c* determines the location of the passenger on the basis of signals received from the base stations 12 and further, on the basis of the location estimates the walking time of the passenger to the allocated elevator/to the elevator to be allocated. By the aid of the walking time the control system optimizes the run routes of the allocated elevator such that it arrives at around the same time at the departure floor of the advance call as the passenger in question. If the position data comprises information about the floor on which the passenger is at the moment of monitoring, the control system can use it as departure floor data for the advance call.

A passenger can register an advance call also from his/her computer terminal 23*b* in the same way as with his/her mobile phone 20. With the reference number 23*c* in FIG. 1 a personal computer terminal at the workpoint of a second person is presented, with which terminal the person can browse the advance calls recorded in the control system and connect, if he/she so desires, his/her own address data to a call that is already registered. When an elevator is allocated according to the advance call, the control system 10*c* sends a notification about the allocation both to the person who registered the call and to the person who gave his/her own address data. The elevator system serves all the passengers belonging to the same advance call with the same elevator if the traffic situation of the elevator system permits it. If passengers are collected from different departure floors, it is taken into account in the routing of the elevator. As an example of the group advance call described above, a situation e.g. in which two people agree to have lunch together can be mentioned.

The control system 10*c* collects statistical data about the elevator journeys made by passengers and records the data in the memory 10*e*. If a passenger uses elevators, on the basis of the statistical data, repeatedly for a journey between a certain floor pair at a certain time of day, the control system automatically registers an advance call for the elevator journey in question. The data (departure floor, destination floor, address data, activation time) of the advance call is obtained from the passenger-specific statistical data. Since the statistical data must be collected for specific passengers individually, passengers are given e.g. a terminal device, an access card or some other identifier, from which each passenger using the elevators can be identified. A passenger can, if he/she so desires, cancel an automatically registered advance call.

According to one embodiment of the invention an information system external to the elevator system sends an advance call to the control system 10*c*, which registers the advance call. The information system is e.g. a server 23*a*, in which is "running" calendar software, in which the employees of a company record meeting invitations and other calendar reservations The application software in the software monitors meeting invitations, identifies the participants in a meeting and sends advance calls to the control system 10*c* concerning those employees who will participate in the meeting. Data about the working floor of each participant and about the floor on which the meeting room is situated is connected to the advance calls. According to the advance calls an elevator is ordered for the aforementioned employees e.g. 5-10 minutes before the start of the meeting. A notification is sent to each employee about the allocation of the elevator. The timetable information of public transport vehicles (buses, trains, metro) can be used, alongside meeting invitations, for registering advance calls. The control system knows of the time it takes a person to go from his/her workpoint to a bus stop and reserves an elevator with an advance call in sufficient time for the person to catch the bus he/she wants. If the person does not, for some reason, want to use bus transportation according to the timetable, he/she can send an acknowledgement to the notification of the advance call, on the basis of which the control system selects from the bus timetable the next bus transport and correspondingly updates the advance call.

The invention is not only limited to be applied to the embodiments described above, but instead many variations are possible within the scope of the inventive concept defined by the claims below. Thus, for example, the control system of the elevator system can comprise a number of separate control units and/or information systems.

The invention claimed is:

1. A method for allocating an elevator in an elevator system, the elevator system including at least one elevator and an interface configured to exchange data, the method comprising:

registering an advance call based on the data received via the interface at a first time, the advance call configured to designate an elevator for use at a second time, the second time being later than the first time;

linking an address data of at least one passenger to the advance call;

allocating the elevator for use by the at least one passenger at the second time; and sending a notification about the allocation of the elevator to the at least one passenger via an address indicated by the address data.

2. The method of claim 1, wherein the advance call from a personal terminal device is registered.

3. The method of claim 1, wherein the advance call from an information system connected to the elevator system is registered.

4. The method of claim 1, wherein the address data includes at least one of a phone number of the personal terminal device of the at least one passenger, and an e-mail address of the at least one passenger.

5. The method of claim 1, further comprising:

monitoring at least one excitation signal from outside the elevator system;

determining the second time based on the excitation signal.

6. The method of claim 1, further comprising:

determining a location of the at least one passenger in a building based on the data received at the first time;

determining the second time based on the location such that an arrival of the at least one elevator matches the arrival of the at least one passenger at a floor level.

7. The method of claim 1, further comprising:

receiving from the at least one passenger an acknowledgement that the at least one passenger has received the notification; and adjusting the second time based on the acknowledgement.

8. The method of claim 1, further comprising:

collecting statistical data about a journey made by the at least one passenger on the elevator; and registering a passenger-specific advance call automatically based on the statistical data.

9. The method of claim 8, wherein the passenger-specific advance call is automatically registered based on a calendar data of the at least one passenger.

10. The method of claim 1, wherein one or more address data items are added to an already registered advance call.

11. An elevator system comprising:

at least one elevator; and a control system, the control system including an interface for exchanging data, the control system being configured to, register an advance call based on the data received via the interface at a first time, the advance call configured to designate an elevator for use at a second time, the second time being later than the first time;

link an address data of at least one passenger to the advance call;

allocate the at least one elevator for use by the at least one passenger at the second time; and send a notification via the interface about the allocation of the elevator to via an address indicated by the address data.

12. The elevator system of claim 11, further comprising:

a base station connected to the interface, the base station configured to, receive the data from a personal terminal apparatus of the at least one passenger, and transmit the data to the control system via the interface.

13. The elevator system of claim 11, further comprising:

an information system connected to the interface, the information system configured to transmit the data to the control system via the interface.

14. The elevator system of claim 11, wherein the control system is further configured to, monitor one or more excitation signals from outside the elevator system; and determine the second time based on the excitation signal.

15. The elevator system of claim 11, wherein the elevator system further comprises:

a position location system configured to determine a location of the at least one passenger in a building based on the data received at the first time, and wherein, the control system is configured to determine the second time based on the location such that an arrival of the at least one elevator matches the arrival of the at least one passenger at a floor level.

16. The elevator system of claim 11, wherein the control system is arranged to, collect statistical data about a journey made by the at least one passenger on the elevator, and register the advance call based on the statistical data.

17. The method of claim 1, wherein the data received via the interface at the first time includes information indicating the second time.

18. The elevator system of claim 11, wherein the data received via the interface at the first time includes information indicating the second time.

* * * * *